US005201170A

United States Patent [19]

Stahlecker et al.

[11] Patent Number: 5,201,170

[45] Date of Patent: Apr. 13, 1993

[54] SPINNING OR TWISTING SPINDLE HAVING A SPINDLE SHAFT

[75] Inventors: Gerd Stahlecker, Eislingen/Fils; Hans Braxmeier, Süssen, both of Fed. Rep. of Germany

[73] Assignees: Fritz Stahlecker; Hans Stahlecker, Fed. Rep. of Germany

[21] Appl. No.: 855,477

[22] Filed: Mar. 23, 1992

Related U.S. Application Data

[63] Continuation of Ser. No. 615,277, Nov. 19, 1990, abandoned.

[30] Foreign Application Priority Data

Dec. 23, 1989 [DE] Fed. Rep. of Germany ..... 3942912

[51] Int. Cl.[5] ..... D01H 7/08; D01H 7/14

[52] U.S. Cl. ..... 57/133; 57/132; 57/134; 57/135; 384/237; 384/239; 384/240

[58] Field of Search ..... 248/636, 638, 562; 57/75, 130, 132, 133, 134, 135; 384/237, 239, 240, 229, 626

[56] References Cited

U.S. PATENT DOCUMENTS

| | | | |
|---|---|---|---|
| 498,952 | 6/1893 | Chandler | 57/132 |
| 574,900 | 1/1897 | Gatner | 57/135 |
| 709,821 | 9/1902 | Kilburn | 384/229 |
| 887,162 | 5/1908 | Westcott | 57/132 |
| 2,169,587 | 4/1937 | Magrath | 384/229 |
| 2,647,806 | 8/1953 | Simmons | 384/241 |
| 2,680,659 | 6/1954 | Morrison et al. | 57/130 |
| 3,435,604 | 4/1969 | Shot Bolt | 57/135 |
| 3,485,029 | 12/1969 | Beerli | 57/134 |
| 4,187,668 | 2/1980 | Olowinski et al. | 248/638 X |
| 4,997,291 | 3/1991 | Braxmeier et al. | 57/135 X |

FOREIGN PATENT DOCUMENTS

| | | | |
|---|---|---|---|
| 673845 | 11/1963 | Canada | 57/130 |
| 0209799 | 7/1985 | European Pat. Off. . | |
| 2749389 | 11/1980 | Fed. Rep. of Germany . | |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In the case of a spinning or twisting spindle having a spindle shaft which is disposed in a spindle bearing housing by means of a bolster and a step bearing, it is provided that the spindle bearing housing is surrounded by a sleeve-type housing which is connected with the bottom of the spindle bearing housing by way of an elastic connecting element which forms a point of discontinuity for the flow of structure-borne sound. In addition, it is provided that the space between the spindle bearing housing and the outer housing is filled with a viscous medium up to at least two-thirds of the height of the spindle bearing housing.

21 Claims, 1 Drawing Sheet

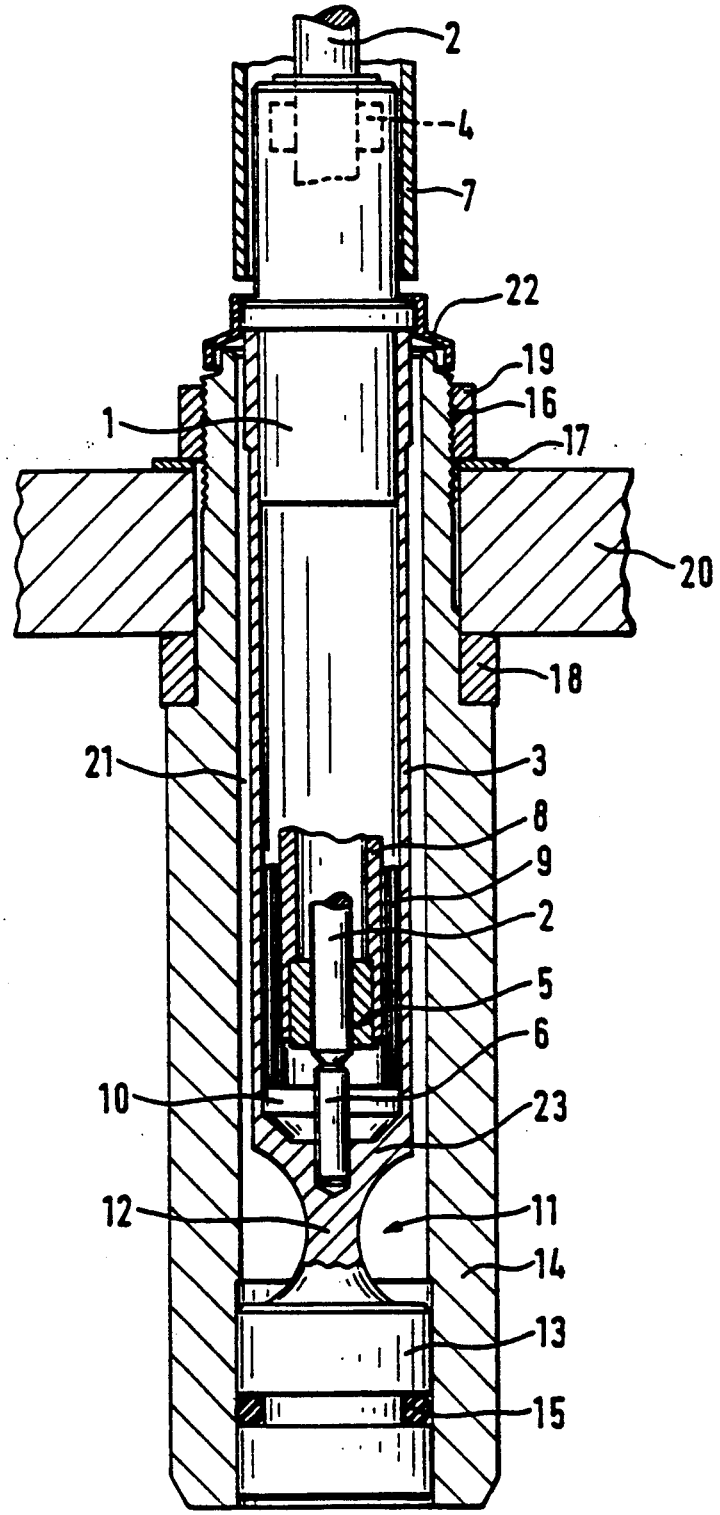
2
4
7
22
19
16
1
17
20
18
21
3
8
9
2
5
6
10
23
12
11
14
13
15

SPINNING OR TWISTING SPINDLE HAVING A SPINDLE SHAFT

This is a continuation of application Ser. No. 07/615,277, filed Nov. 19, 1990, now abandoned.

BACKGROUND AND SUMMARY OF THE INVENTION

The invention relates to a spinning or twisting having a spindle shaft which, by means of a bolster and a step bearing, is disposed in a spindle bearing housing for which a holding device is provided which is applied in the area of the step bearing and is spring-elastically flexible essentially radially with respect to the spindle axis.

In the case of a known spinning or twisting spindle of the initially mentioned type (EP-A 0 209 799), the holding device comprises a sleeve mounted on the spindle bearing housing in the area of the step bearing and a sleeve which is arranged at an axial distance to it, surrounds the spindle bearing housing at a distance and is used for fastening to a spindle rail. Between the two sleeves, a ring of axially extending bendable spring bars is provided which are arranged at a uniform distance. As a result, it is to be achieved that the spindle bearing housing can be deflected only radially with respect to the spindle axis.

In order to reduce running noises of spinning or twisting spindles of the initially mentioned type, it is provided according to commonly assigned U.S. Pat. application Ser. No. 07/606,724, filed Oct. 31, 1990 corresponding to German Application P 39 38 255.9, that a connecting element is arranged in the area of the step bearing between the spindle bearing housing and a housing surrounding the spindle bearing housing at a distance, which connecting element is designed as a point of discontinuity for the flow of structure-borne sound.

It is an object of the invention to construct a spinning or twisting spindle of the initially mentioned type such that the air-borne noises are reduced.

This object is achieved in that a spring-elastic connecting element is arranged between the spindle bearing housing and a sleeve-type housing which surrounds it at a distance and can be mounted on a spindle rail, which connecting element forms a point of discontinuity for the flow of structure-borne sound, and in that the space between the surrounding support housing and the spindle bearing housing is filled up to at least two thirds of the height of the spindle bearing housing with a medium which is viscous in a temperature range of approximately 20° to 60° C.

First, the invention is based on the recognition that the bolster, which normally contains roller bodies, is the main cause of the running noises. Even if the bolster has a high precision with respect to shape, and there is only little play in the area of the bolster, small deviations of the running surface cannot be avoided. These have the result that the roller bodies and thus also the spindle bearing housing are caused to perform vibrations. In the so-called flow of structure-borne sound, these vibrations are then transmitted to other machine elements which have larger surfaces that can vibrate and therefore increase the generating of noise. By means of the point of discontinuity, it is achieved that the flow of structure-borne sound is significantly reduced in this area so that vibrations of the spindle bearing housing are transmitted to other machine elements and particularly to the spindle rail only to a significantly reduced degree. The running noises are therefore essentially reduced to the spindle bearing housing as the source of noise. In this case, the sleeve-type housing which surrounds the spindle bearing housing acts as a shield. The additional filling of the space between the spindle bearing housing and the support housing with a viscous medium has the additional result that the vibrations of the spindle bearing housing are damped so that a further reduction of noise is achieved.

In a further development of the invention, it is provided that the spindle bearing housing has mass that is smaller than the outer support housing. As a result, it is achieved that the spindle bearing housing and the outer housing do not vibrate with the same frequencies so that the vibrations of the spindle bearing housing which are damped by the inserted medium also do not result in excited vibrations of the outer housing.

Other objects, advantages and novel features of the present invention will become apparent from the following detailed description of the invention when considered in conjunction with the accompanying drawings.

BRIEF DESCRIPTION OF THE DRAWINGS

The single drawing FIG. illustrates an axial sectional view of a spinning or twisting spindle which is fastened to a spindle rail by way of an outer housing surrounding the spindle bearing housing at a distance, constructed according to a preferred embodiment of the invention.

DETAILED DESCRIPTION OF THE DRAWINGS

The spinning or twisting spindle 1 comprises a spindle shaft 2 which is non-rotatably connected with the top part of the spindle and which is disposed in a spindle bearing housing 3 by means of a bolster 4 and a step bearing 5. The step bearing 5 has a bearing sleeve held by means of a centering sleeve 8. The centering sleeve 8 is radially held by means of a damping coil 9 which supports itself in the axial direction against a bottom plate 10. The step bearing 5 also comprises a pivot bearing pin 6 on which the end of the spindle shaft 2 is supported.

In a manner not shown in detail, the bolster 4 is constructed as a roller bearing, the roller bodies of which run on the spindle shaft 2 and are guided on the outside by means of an outer ring.

The spindle bearing housing 3 is extended in the axial direction beyond its bottom 23 by means of a pin-type projection 12 which forms a contraction, that is, which has a much smaller cross-section than the spindle bearing housing 3. The pin-type projection 12 changes into a cylindrical widened continuation 13 which is pressed into a sleeve-type outer housing 14. A sealing ring 15 is provided in the area of this continuation 13.

The sleeve-type outer support housing 14, which has a significantly larger wall thickness than the spindle bearing housing 3, extends upward to adjacent the area of a wharve 7 which is fixedly connected with the spindle shaft 2 and which is situated in the area of the bolster 4. By way of the wharve 7, a drive of the spindle shaft 2 takes place by means of a tangential belt or the like which is not shown.

A cover 22 in the form of a ring is mounted on the spindle bearing housing 3 and reaches over the upper end of the outer housing 14.

In the area of its upper end, the outer housing 14 is fastened to a spindle rail 20. It is provided with an external thread 16 and is fitted through a bore of the spindle rail 20. On both sides of the spindle rail 20, rings 17, 18 are arranged which, in the areas opposite one another, have a slight wobble so that, by means of a mutual twisting of these rings 17, 18, the angular position can be adjusted of the outer housing 14 and thus of the spindle bearing housing 3 with the spindle shaft 2. The outer housing 14 is held by means of a nut 19 screwed onto the external thread 16.

The pin-type projection 12 of the spindle bearing housing 3 forms a point of discontinuity 11 for structure-borne sound so that the flow of structure-borne sound from the spindle bearing housing 3 to the outer housing 14 and thus to the spindle rail 20 is largely interrupted or at least considerably reduced. In addition, the projection 12 allows an elastic deformation which takes place around an imaginary tilting axis in the area of the contraction so that the spindle bearing housing 3 in the area of the bolster 4 and therefore also in the area of the wharve 7 is spring-elastically flexible essentially in the radial direction. In this manner, the running noises originating from the bolster 4 are limited essentially to the noise radiating from the spindle bearing housing 3 which is also largely shielded off by the outer housing 14.

A further reduction of noise is achieved in that the space 21 between the spindle bearing housing 3 and the outer housing 14 surrounding it at a distance is filled with a medium which is viscous at normal operating temperatures. The normal operating temperatures are in a range of from 20° C. to 60° C. In this case, the space 21 is filled so far that at least ⅔ of the height of the spindle bearing housing 3 are covered by this medium. In order to prevent that the medium leaks out of the space 21, it may additionally be provided in a modified embodiment that a sealing ring made of a rubber-elastic material is provided in the upper area between the spindle bearing housing 3 and the outer housing 14. As a result, it will then be possible to fill the space 21 virtually along the complete height with the viscous medium. Greases or resins which are viscous in this temperature range are suitable to be used as the medium that is viscous at the operating temperatures. Another selection criterion for the medium is that it has a relatively high wettability, i.e., largely avoids the formation of hollow spaces.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Spinning or twisting spindle apparatus comprising:

a spindle bearing housing including a spindle shaft bearing inside the spindle bearing housing for rotatably supporting a spindle shaft, said spindle shaft bearing including a centering sleeve holding a step bearing sleeve, said centering sleeve being disposed inside of said bearing housing, said spindle bearing housing exhibiting a height extending over the length thereof, a support housing surrounding the spindle bearing housing with a spacing therebetween, said support housing being connectable directly to a spindle rail, a substantially incompressible connecting element arranged between the support housing and the spindle bearing housing, said connecting element forming a point of discontinuity for flow of structure-borne sound from the spindle shaft bearing to the support bearing and thus the spindle rail, and a fluid medium filled into the space between the spindle bearing housing and the surrounding support housing to a level at least two-thirds of the height of the spindle bearing housing, said fluid medium being viscous in a temperature range of between 20° C. and 60° C.

2. Apparatus according to claim 1, comprising a spindle shaft, wherein the spindle shaft bearing means includes a bolster and step bearing for supporting the spindle shaft in the spindle bearing housing.

3. Apparatus according to claim 1, wherein the bottom of the spindle bearing housing is extended by means of a pin forming said connecting element, said pin having a smaller cross-section than the spindle bearing housing and by means of which the spindle bearing housing is connected with the support housing.

4. Apparatus according to claim 3, wherein the pin exhibits a contraction along a portion of its length.

5. Apparatus according to claim 4, wherein the spindle bearing housing has a mass that is smaller than that of the surrounding support housing.

6. Apparatus according to claim 5, wherein the space between the support housing and the spindle bearing housing is closed off in the area of an upper end of the support housing.

7. Apparatus according to claim 6, comprising a spindle shaft, wherein the spindle shaft bearing means includes a bolster and step bearing for supporting the spindle shaft in the spindle bearing housing.

8. Apparatus according to claim 1, wherein the spindle bearing housing has a mass that is smaller than that of the surrounding support housing.

9. Apparatus according to claim 8, wherein the space between the support housing and the spindle bearing housing is closed off in the area of an upper end of the support housing.

10. Apparatus according to claim 1, wherein the space between the support housing and the spindle bearing housing is closed off in the area of an upper area of the support housing.

11. Apparatus according to claim 1, wherein only a single connecting element is provided and disposed at a single position along the length of the spindle bearing housing.

12. Apparatus according to claim 11, wherein said connecting element is integrally connected with the spindle bearing housing.

13. Spinning or twisting spindle apparatus comprising:

a spindle bearing housing including a spindle shaft bearing inside the spindle bearing housing for rotatably supporting a spindle shaft, said spindle shaft bearing including a centering sleeve holding a step bearing sleeve, said centering sleeve being disposed inside of said bearing housing, said spindle bearing housing exhibiting a height extending over the length thereof, a support housing surrounding the spindle bearing housing with a spacing therebetween, said support housing being connectable directly to a spindle rail, and a substantially incompressible connecting element arranged between the support housing and the spindle bearing housing, said connecting element forming a point of discontinuity for flow of structure-borne sound from the spindle shaft bearing to the support housing and thus the spindle rail.

14. An apparatus according to claim 13, wherein the bottom of the spindle bearing housing is extended by means of a pin forming said connecting element, said pin having a smaller cross-section than the spindle bearing housing and by means of which the spindle bearing housing is connected with the support housing.

15. An apparatus according to claim 14, wherein the pin exhibits a contraction along a portion of its length.

16. An apparatus according to claim 15, wherein the spindle bearing housing has a mass that is smaller than that of the surrounding support housing.

17. An apparatus according to claim 13, wherein the spindle bearing housing has a name that is smaller than that of the surrounding support housing.

18. An apparatus according to claim 17, wherein the space between the support housing and the spindle bearing housing is closed off in the area of an upper end of the support housing.

19. An apparatus according to claim 13, wherein the space between the support housing and the spindle bearing housing is closed off in the area of an upper end of the support housing.

20. An apparatus according to claim 13, wherein only a single connecting element is provided and disposed at a single position along the length of the spindle bearing housing.

21. An apparatus according to claim 20, wherein said connecting element is integrally connected with the spindle bearing housing.

* * * * *